United States Patent [19]

Vildosola

[11] Patent Number: 4,780,973

[45] Date of Patent: Nov. 1, 1988

[54] WATER BYPASS VALVE FOR STEAM IRONS WITH DISPLACEABLE BYPASS BLOCKING PLATE

[75] Inventor: Tomas B. Vildosola, Eibar, Spain

[73] Assignee: Oficina de Investigacion Agrupada, S.A., Spain

[21] Appl. No.: 923,969

[22] Filed: Oct. 28, 1986

[30] Foreign Application Priority Data

Oct. 30, 1985 [ES] Spain ..... 289,976

[51] Int. Cl.[4] ..... D06F 75/18

[52] U.S. Cl. ..... 38/77.7; 38/77.83; 251/11

[58] Field of Search ..... 38/77.7, 77.83; 251/11; 219/273

[56] References Cited

U.S. PATENT DOCUMENTS 3,111,780 11/1963 Smith ..... 38/77.7
4,125,953 11/1978 Colombo ..... 38/77.7
4,285,145 8/1981 Balchunas ..... 38/77.83
4,627,181 12/1986 Bastida ..... 38/77.7

FOREIGN PATENT DOCUMENTS 2043706 10/1980 United Kingdom ..... 38/77.83

*Primary Examiner*—Andrew M. Falik
*Attorney, Agent, or Firm*—Lucas & Just

[57] ABSTRACT

A water bypass valve for a steam iron controls the passage of water between a tank and a vaporization chamber. The valve has an inlet which is opened and closed by a temperature sensitive element that prevents water from entering into the valve until the vaporization chamber is of sufficient temperature. The outlet of the valve is opened and closed by a locking pin that is controlled by the operator and is not temperature sensitive. The temperature sensitive element is separate and distinct from the locking pin.

3 Claims, 2 Drawing Sheets

WATER BYPASS VALVE FOR STEAM IRONS WITH DISPLACEABLE BYPASS BLOCKING PLATE

BACKGROUND OF THE INVENTION

Irons are known which use the steam generated by themselves to facilitate ironing and basically comprise a tank in which water is stored to be supplied through a duct (at the time of ironing) to a vaporizing chamber that is located in the soleplate of the iron and is heated by electric resistors. In these irons there is no possibility of closing off passage through the duct nor, therefore, of regulating the quantity of steam in accordance with the needs of the garment to be ironed, but rather the duct is always open and water constantly flowing through and being vaporized in the vaporizing chamber.

Steam irons are also known which correct the problem indicated by disposing of a lock pin in the drip valve inserted in the water bypass to the vaporizing chamber.

These irons equipped with drip valve with lock pin, though improving on their predecessors, present the disadvantage that the passage of water to the vaporizing chamber, when the lock pin is in the proper position, occurs without the chamber having reached sufficient temperature and that results, at the beginning of ironing or because of the reduction of temperature due to ironing itself, in the discharge of unvaporized drops of water outside the iron, overly dampening the garment and making ironing difficult.

With a view to solving this problem, irons are known that dispose of a bimetallic element and a lock pin, the head of which, in normal operation of the iron, is permanently seated on the drip valve until the vaporizing chamber acquires sufficient temperature and the bimetallic element is excited and displaces the head of the pin from its seat to the extent corresponding to the position selected by an external regulating control. An iron of this type is that corresponding to U.S. Pat. No. 4,125,953.

The most important characteristic of this type of iron is that excitation of the bimetallic element is used directly to displace the lock pin from its permanent seat and as locking is ensured by the action of a resilient spring, this means that:

the lock pin must have a special configuration or be connected with the bimetallic element through some intermediate piece, so that the movement of the bimetallic element is converted into a pin opening displacement;

the bimetallic element has to possess special characteristics of mechanical strength, since stresses capable of overcoming the resistance of the resilient spring ensuring the seating of the lock pin are accomplished by the movement of the bimetallic element and bimetallic elements are not normally subjected to such stresses;

the resilient spring as well as the bimetallic element must be perfectly calibrated so that on different irons a given position of the regulating control will always correspond to the same degree of discharge of steam, for otherwise the quality of ironing and of the iron itself would be affected. This calibration also has to be such that it enables the bimetallic element to compress the spring in the opening, without impairing the pressure necessary for seating of the pin, which is also entrusted to the spring;

the end of the lock pin as well as the element on which it is seated suffer excessively due to the continuous reciprocal seatings that are necessary in this mode of operation.

SUMMARY OF THE INVENTION

The present invention is an improved water bypass valve for a steam iron of the type that controls the flow of water between the water tank and the vaporizing chamber. A displacement plate controls the flow of water into the valve from the water tank. The head of the displacement plate closes off a hole between the water tank and the valve. A bimetallic element acts on the tail of the displacement plate such that when the temperature in the vaporizing chamber is sufficiently high to excite the bimetallic element, water is permitted to flow into the valve from the water tank. The bypass valve also has a locking pin, one end of which is connected to an external regulating control and the other end of which is seated in the water outlet port of the valve. The external regulating control determines whether the other end of the locking pin is seated in the water outlet port or is retracted from the water outlet port. The external regulating control also determines the amount of water flowing into the vaporizing chamber by controlling the degree of separation between the other end of the locking pin and the outlet. The locking pin and displcement plate operate independently of each other.

To have an iron which incorporates the present invention function as a 'steam iron', the external regulating control is adjusted such that the other end of the locking pin is retracted from its seated position. To have this iron function as a 'dry iron', the external regulating control is adjusted such that the other end is seated in the outlet port of the valve.

The operation of the present invention, according to this simple recommended arrangement, is as follows:

When sufficient temperature exists in the vaporizing chamber, the bimetallic element is excited, acting on the tail of the small displaceable plate and causing the head of the small displacement plate to unblock the port between the water tank and the valve body; if at that time the control is in the dry ironing position, the pin will be locking the outlet of the valve body and the water will not pass to the through the outlet of the valve body; on the other hand, if the control is in any of the steam ironing positions, the end of the pin will be separated from its seat to the corresponding degree and will permit passage of the water to an equal extent to the vaporizing chamber.

To understand the nature of this invention better, we present on the attached drawing a schematic representation of its use, being absolutely nonrestrictive and therefore subject to additional changes that do not alter the essential characteristics.

DESCRIPTION OF THE PREFERRED EMBODIMENTS

The present invention is an improved water bypass valve for steam irons that control passage between the water tank 1 situated at the top and the vaporizing chamber 2 defined in the soleplate 3 of the iron, in which the heating resistor 4 is incorporated.

Figure 1:
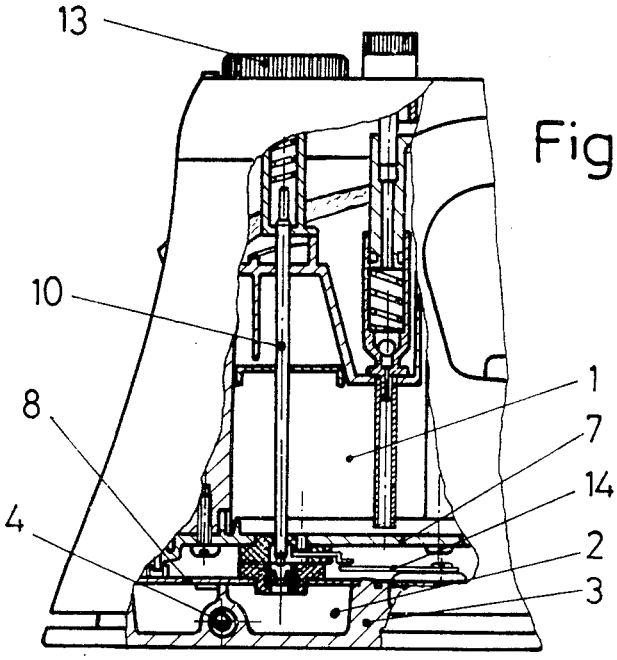
FIG. 1 is a side view of the front part of the iron, representing a partial section of the iron in order to show the internal arrangement of the members. The end of the pin separated from its seat and the bimetallic element in rest position are represented in the iron.
Figure 2:
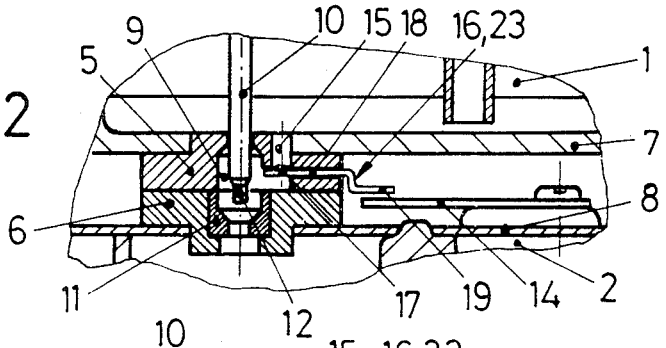
FIGS. 2 and 3 are expanded views of the zone of FIG. 1 in which the lower part of the lock pin, the valve body, the displaceable plate and the bimetallic element appear. On FIG. 2 the same position of FIG. 1 is represented and in FIG. 3 the bimetallic element is excited and the water bypass is open.
Figure 3:
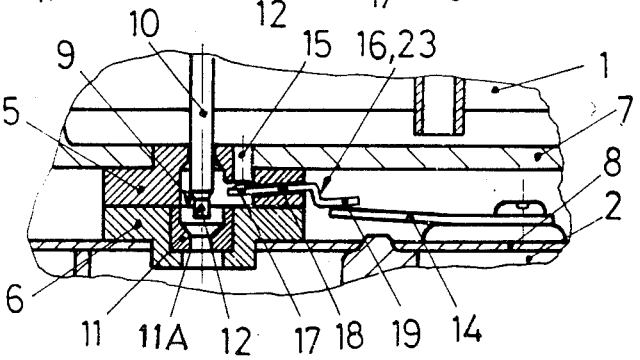
Figure 5:
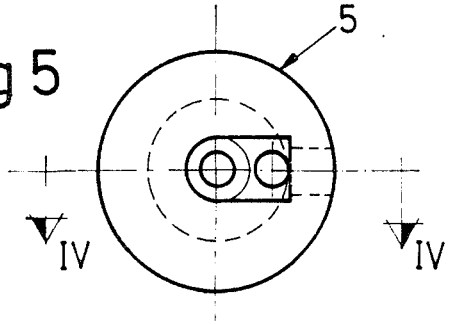
FIG. 5 is a lower plan view according to FIG. 4 of the upper valve half-body unsectioned.
Figure 7:
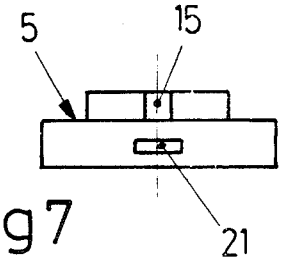
FIG. 7 is a right side elevation according to FIG. 4, representing the upper valve half-body.
Figure 4:
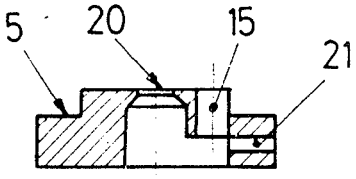
FIG. 4 is an elevation representing the upper valve half-body sectioned along line IV—IV indicated on FIG. 5.
Figure 6:
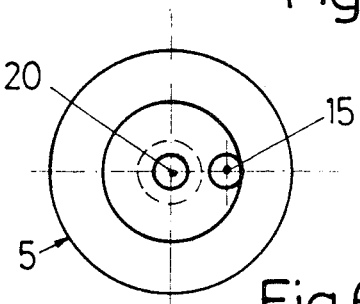
FIG. 6 is an upper plan view according to FIG. 4 of the upper valve half-body.

As is shown in FIGS. 1 to 3, the valve body consists of an upper half-body 5 and a lower half-body 6, both of elastomer material and stepped configuration, which half-bodies are coupled opposite each other by placing their circular faces of greater diameter back to back, so that the wider center part of the valve body formed is located right between the floor 7 of the water tank 1 and the roof 8 of the vaporizing chamber, while the part of lesser diameter of the upper half-body 5 is tightly fitted through the floor 7, and the corresponding one of the lower half-body 6 is tightly fitted in the roof 8.

Between both half-bodies 5, 6 a recess 9 is defined inside, which is limited at the top by an opening 20 that permits the moving member of the valve, or lock pin 10 to slide while also providing a seal. The recess 9 being limited at the bottom by a seating piece 11 for the end 12 of the pin 10, which is of ceramic, metal or other material of suitable hardness, and that is embedded in the lower half-body 6, which in turn has a drill hole 11A that connects the recess 9 outside through the seating piece 11 of the pin 10, when the end 12 of the latter is not blocking drill hole 11A.

The lock pin 10 is worked solely and exclusively by the external control 13, by means of which is selected the desired mode of ironing, dry or steam, and the quantity of steam required. The mode, generally, being selected according to the characteristics of the fabric to be ironed. Working this control 13 will determine at any time the position of the end 12 of the pin 10, independent of what is the status of the bimetallic element 14, so that seating between the end 12 of the pin 10 and the piece 11 will only take place when the control 13 is in the position corresponding to dry ironing, that is, with absence of steam.

The recess 9 is joined laterally by a bypass 15 with the water tank 1, which bypass 15 can be blocked by the head 17 of a displaceable plate that has its body 18 inserted in the elastomer material of the upper half-body 5 and that presents outside the latter a tail 19 which is brought face to face vertically with the free end of a bimetallic element 14, having its other end fastened on the roof 8 and therefore detecting the temperature existing in the chamber 2 with great accuracy.

Figure 8:
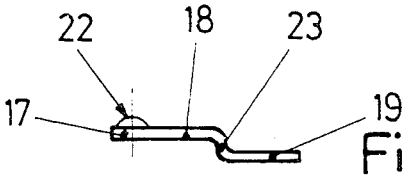
FIG. 8 is a side elevation of the displaceable plate, in which the spherical projection of the head is shown.
Figure 9:
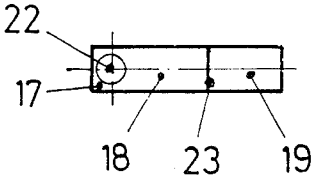
FIG. 9 is an upper plan view according to FIG. 8, representing the displaceable plate.

As is shown in FIGS. 8 and 9, in order to obtain an effective blocking of the bypass 15, in the present invention it is arranged for the head 17 of the displaceable plate 16 to possess a spherical cap-shaped projection 22 that ensures perfect lock seating on the mouth of the bypass 15, although there can be reasonable variations in the positioning of the head 17 between some irons and others. It is to be noted at this point that between the body 18 and the tail 19 of the plate 16 a step 23 exists, which favors the positioning of said tail 19 opposite the bimetallic element 14.

FIGS. 4 to 7 show in detail the arrangement of the upper half-body 5, in which the following parts are defined: the inlet 20 for the exact tight passage of the pin 10; the upper part of the inner recess 9; the water bypass 15 from the tank 1 to the recess 9; the mortise 21 in which the body 18 of the displaceable plate 16 is inserted.

With this arrangement of the present invention, when a high enough temperature exists for vaporization of the water in the chamber 2, the bimetallic element 14 is excited, making the displacement of its free end work on the tail 19 of the displaceable plate 16, which will to be able to return to the rest position and reseal the mouth of bypass 15 once bimetallic element 14 is not in an excited state thanks to the resilience of the material of the half-body 5 in which its body 18 is inserted; this tipping will make the head 17 drop, freeing the opening of the bypass 15, which in rest position is kept permanently blocked by the projection 22 of the head 17. Once the bypass 15 has thus been unblocked, the water from the tank 1 will have access to the recess 9 and from there to the chamber 2, if the end 12 of the pin 10 is separated from the piece 11, that is, if the operating mode selected on the control 13 is steam ironing. On the other hand, if the operating mode is dry ironing, the end 12 of the pin 10 will be seated on the piece 11 and then, even when the bypass 15 is open to the passage of water, the latter will be retained in the recess 9 and no steam will be produced.

The nature of this invention as well as its industrial application having been sufficiently described, it only remains to be added that it is possible to introduce changes of form, material and arrangement in the invention as a whole and in its components, as long as such alterations do not involve any substantial variation of same.

The following features are indicated in the drawings:

1. Water tank
2. Vaporizing chamber
3. Soleplate
4. Resistor
5. Upper valve half-body
6. Lower valve half-body
7. Floor of the tank (1)
8. Roof of the chamber (2)
9. Valve recess
10. Lock pin
11. Valve seating piece
12. End of pin (10)
13. External control
14. Bimetallic element
15. Water bypass
16. Displaceable plate
17. Head of displaceable plate
18. Body of displaceable plate
19. Tail of displaceable plate
20. Inlet of pin (10)
21. Mortise
22. Spherical projection 23. Step

What is claimed is:

1. A water bypass valve in a steam iron that controls the passage of water between a water tank and a vaporizing chamber located in said steam iron comprising:

(a) a lower half-body, said lower half-body having an outlet port and a valve seat positioned in said outlet port;

(b) an upper half-body, said upper half-body having an inlet port, a lock pin passageway and a displacement plate mortise, said lower half-body and said upper half-body being joined such that a through passageway is formed between said inlet port and said outlet port and said locking pin passageway is concentric with said outlet port;

(c) a bimetallic element connected to a surface on said vaporization chamber;

(d) a displacement plate positioned in said displacement plate mortise, said displacement plate having a first end resiliently held against said inlet port thereby closing said inlet port, said displacement plate having a second end spaced apart from said bimetallic element such that said bimetallic element can make contact with said second end of said displacement plate when said bimetallic element is in an excited state and thereby cause said first end of said displacement plate to move away from said inlet port thereby opening said inlet port;

(e) a locking pin movably positioned in said lock pin passageway and movable between a closed position in which said lock pin is in engagement with said valve seat thereby closing said outlet port, and an open position in which said lock pin is away from said valve seat thereby opening said outlet port; and (f) control means connected to said locking pin to control the movement of said locking pin between said closed position and said open position.

2. The water bypass valve of claim 1 wherein said first end of said displacement plate has a spherical cap-shaped projection for engagement with said inlet port.

3. The water bypass valve of the claim 1 wherein said displacement plate has a step shaped configuration.

* * * * *

UNITED STATES PATENT AND TRADEMARK OFFICE

CERTIFICATE OF CORRECTION

PATENT NO. : 4,780,973

DATED : November 1, 1988

INVENTOR(S) : Tomas Bastida Vildosola

It is certified that error appears in the above-identified patent and that said Letters Patent are hereby corrected as shown below:

Column 6, line 7, change "locking" to --lock--; line 20, delete "the" (second instance).

Signed and Sealed this

Twenty-eighth Day of March, 1989

*Attest:*

DONALD J. QUIGG

*Attesting Officer*

*Commissioner of Patents and Trademarks*